United States Patent [19]

Flament

[11] Patent Number: 4,838,185

[45] Date of Patent: Jun. 13, 1989

[54] FLUID FUEL COMBUSTION PROCESS AND TURBULENT-FLOW BURNER FOR IMPLEMENTING SAME

[75] Inventor: Gérard Flament, Douai, France

[73] Assignee: Charbonnages De France, Paris, France

[21] Appl. No.: 96,306

[22] Filed: Sep. 8, 1987

Related U.S. Application Data

[63] Continuation of Ser. No. 856,975, Apr. 29, 1986, abandoned.

[30] Foreign Application Priority Data

May 3, 1985 [FR] France ..... 85 06750

[51] Int. Cl.[4] ..... F23D 1/02; F23K 5/00

[52] U.S. Cl. ..... 110/347; 110/263; 110/264; 110/265

[58] Field of Search ..... 110/347

[56] References Cited

U.S. PATENT DOCUMENTS

| | | | |
|---|---|---|---|
| 4,147,116 | 4/1979 | Graybill | 110/263 |
| 4,270,895 | 6/1981 | Vatsky | 110/264 |
| 4,303,386 | 12/1981 | Voorheis et al. . | |
| 4,333,405 | 6/1982 | Michelfelder et al. | 110/265 |
| 4,381,718 | 5/1983 | Carver et al. . | |
| 4,422,389 | 12/1983 | Schroder | 110/264 |
| 4,438,707 | 3/1984 | Deloplace et al. | 110/347 |
| 4,457,241 | 7/1984 | Itse et al. | 110/347 |
| 4,512,267 | 4/1985 | Cegielski, Jr. et al. . | |
| 4,523,530 | 6/1985 | Kaminaka et al. | 110/264 |
| 4,545,307 | 10/1985 | Morita et al. | 110/264 |
| 4,547,147 | 10/1985 | Suzuki et al. . | |
| 4,551,090 | 11/1985 | Leikent et al. | 110/265 |
| 4,555,994 | 12/1985 | Voigt et al. | 110/264 |
| 4,602,571 | 7/1986 | Chadshay | 110/265 |

FOREIGN PATENT DOCUMENTS

| | | |
|---|---|---|
| 3131962 | 2/1983 | Fed. Rep. of Germany . |
| 3310500 | 10/1984 | Fed. Rep. of Germany . |
| 2522392 | 9/1983 | France . |
| 57-155004 | 9/1982 | Japan . |
| 251223 | 8/1948 | Switzerland . |
| 2118711 | 11/1983 | United Kingdom . |

OTHER PUBLICATIONS

*Combustion Engineering*. Otto de Lorenzi, M. E., Combustion Engineering Co., Inc., First Edition, 1948, New York, pp. 8.1–8.25 and 22.10–22.48.

*Primary Examiner*—Henry C. Yuen

*Attorney, Agent, or Firm*—Browdy and Neimark

[57] ABSTRACT

In this combustion process a fluid fuel such as pulverized coal mixed with primary air is injected along an axis and secondary air is injected along a helical path around the axis. Tertiary air is injected around the combustible fluid and the secondary air in substantially the same direction as the combustible fluid, in a substantial circumferentially continuous coaxial ring which is laterally confined downstream of the injection point.

9 Claims, 1 Drawing Sheet

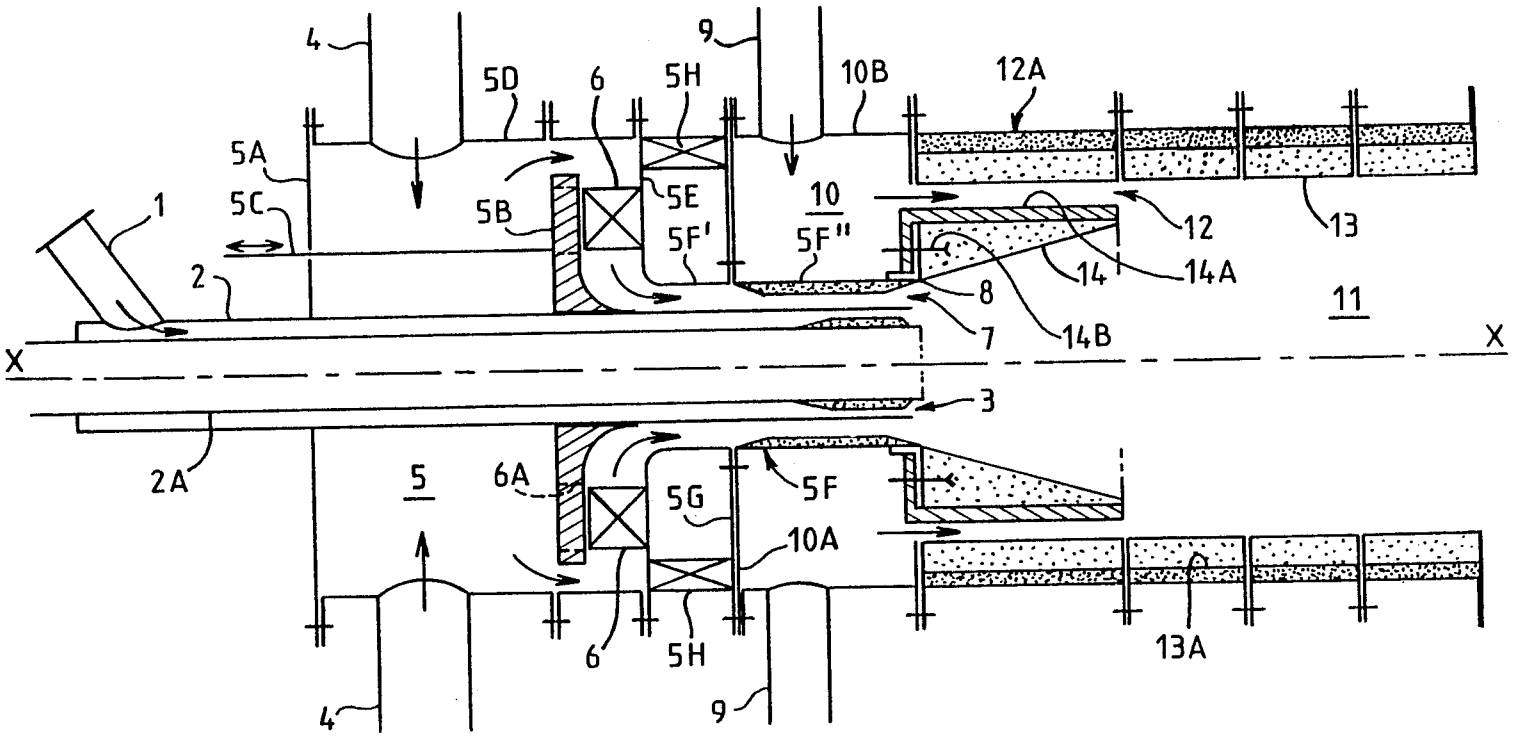
X
11
13
12
14A
14
14B
12A
8
7
3
13A
10B
10
5F''
5F
10A
9
5H
5E
5F'
5G
6
5D
5B
6A
5
4
5A
5C
2
2A
1

FLUID FUEL COMBUSTION PROCESS AND TURBULENT-FLOW BURNER FOR IMPLEMENTING SAME

This application is a continuation of application Ser. No. 856,975, filed Apr. 29, 1986, now abandoned.

BACKGROUND OF THE INVENTION

1. Field of the Invention

The invention concerns a process for burning fluid fuels such as pulverized coal in suspension in air and a turbulent-flow burner for implementing this process.

2. Description of the prior art

The term turbulent-flow burners designates burners in which a fluid fuel such as pulverized coal in suspension in a primary air flow is introduced into a combustion zone by means of a nozzle and in which the secondary air needed for burning the fuel is caused to swirl around the end of the nozzle, for example by means of deflector plates usually called swirl vanes. A burner of this kind is described in French Pat. No. 2,054,741, for example.

These burners impose on the combustion products a vortex movement (usually called "swirl") which brings about intensive internal recirculation of the fuel and the gases, improving combustion and procuring vigorous intermixing of the products. This motion is characterized by the "swirl number" which represents the ratio of the angular momentum flowrate to the axial motion quantity flowrate for a given radius of the flow of products discharged from the burner.

In certain cases the use of this type of burner makes it difficult to obtain a flame which is stable and which is not excessively cooled by radiation to the walls of the combustion zone and by recirculation of external gases into the flame, the consequence of which is reduced combustion efficiency. Moreover, the resulting flame has a relatively large diameter and it may be desirable to confine it within as small a volume as possible, especially if the burner is used in a compact combustion zone such as a dryer drum.

It has already been proposed in French Pat. application No. 2,564,950 to limit the volume of a turbulent-flow burner flame by passing it into a confinement chamber. The walls of such a chamber may, however, be raised to a temperature causing them to be fouled by the adhesion of hot ash particles and to deteriorate rapidly, despite the use of refractory materials.

An object of the present invention is to propose a combustion process and a burner implementing this process which make it possible to circumvent the above disadvantages and consequently to achieve substantially complete combustion of the fuel in a highly stable and compact flame, also avoiding deposits of solid materials on the walls of the chamber and the combustion zone.

Another object of the invention is to propose a burner which can function without supporting the fuel and without preheating of the combustion air, in other words in which the stability of the flame is independent of the thermal conditions imposed by the combustion chamber.

These objects are achieved if there is provided around the flame as aerodynamic complementary air jacket which isolates the combustion chamber and within which the fuel is virtually completely combusted.

SUMMARY OF THE INVENTION

The invention consists in a combustion process wherein a fluid fuel such as pulverized coal mixed with primary air is injected along an axis, secondary air is injected along a helical path around said axis, and tertiary air is injected around the combustible fluid and the secondary air substantially in the same direction as the combustible fluid in a coaxial ring which is substantially continuous circumferentially and laterally confined downstream of the point of injection, said tertiary air discharging along the wall of a combustion chamber which extends in the downstream direction.

According to other, preferred characteristics of the invention:

the axial component of the velocity of the tertiary air on entering the combustion chamber is of the same order of magnitude as the axial component of the velocity of the combustion gases circulating in the same area, the mass flowrate of the tertiary air is between 0.2 and 1.5 times the total mass flowrate of the primary and secondary air, the diameter of the ring in which form the tertiary air is injected is between 1.8 and 3.6 times the diameter of the burner outlet, the tertiary air is injected at a distance downstream of the burner outlet between 0.5 and 1.5 times the diameter of the burner outlet, the total mass flowrate of the primary and secondary air is between 0.5 and 1.2 times the stoichiometric air mass flowrate, the total mass flowrate of the combustion air is between 1.2 and 1.6 times of the stoichiometric air mass flowrate, the swirl number at the burner outlet is between 0.3 and 2, the tertiary air discharges along the wall of a cylindrical combustion chamber extending in the downstream direction over a length between 0.2 and 1 times the diameter of the ring.

The tertiary air flowrate must be of the same order of magnitude as the secondary air flowrate because its function is to create a jacket of cold air between the jet of burning gases and the wall of the combustion chamber so that combustion can take place within this chamber without damaging the walls. In particular, this cold tertiary air jacket has to cool ash particles in the vicinity of the wall and prevent them coming into contact with the wall and adhering to it. Another effect of this parietal flow of cold air is to cool the wall, which is beneficial to its durability. Specifically, this flow prevents recirculation of particle laden combustion gases between the air and the wall.

The length of the combustion chamber is sufficient to permit the major part of combustion to take place within it and at least sufficient to allow stable retention of the flame independently of the conditions and of the geometry of the space into which the burner discharges. There is thus obtained, starting from the point of injection of the fuel, a substantially adiabatic enclosure within which the flame is stabilized and the major part of combustion takes place.

The quantity of tertiary air required to protect the walls of the combustion chamber may be such that, if there is a requirement to maintain a relatively low overall excess air value (an air factor less than 1.6), it is necessary to operate with reduced air prior to injection of the tertiary air. This will not necessarily be required, but can be advantageous since sub-stoichiometric combustion in a first phase may be beneficial from the ignition point of view when this is not favored for other reasons (cold combustion air, difficult to ignite fuel) and from the point of view of reduced emission of $No_x$. Sub-stoichiometric combustion may even be essential when operating under conditions that make ignition difficult, for example: cold combustion air (especially in winter), large particle size, fuel with low content of volatile substances, fuel with high ash or moisture content.

The swirl number of the flow produced by the primary and secondary air is moderate (0.3 to 2) but sufficiently high to create an area of internal recirculation of the hot burned gases which provides for heating and thus rapid ignition of the fuel immediately it comes into contact with the secondary air.

In another aspect, the invention consists in a turbulent-flow burner for implementing the process in accordance with the invention comprising a pipe for feeding fuel and possibly primary air along an axis, a feed device for injecting secondary air along a helical path around said axis and a device for injecting tertiary air in a ring around said axis and parallel to the direction in which the fuel is injected. According to preferred characteristics of the invention, this tertiary air injector device is in a plane perpendicular to the axis situated at a distance from the tip of the burner between 0.5 and 1.5 times the diameter of the burner outlet and has a diameter between 1.8 and 3.6 times the diameter of the burner outlet.

According to other characteristics of the invention:

the tertiary air injection device is situated in the vicinity of the wall of a coaxial cylindrical combustion chamber, the length of the combustion chamber is between 0.2 and 1 times its diameter, the burner outlet is coupled to the combustion chamber by a frustoconical refractory throat adapted to resist a temperature of 1,400° C. and with a half-angle at the tip advantageously between 10° and 35°.

The tertiary air injector device may consist of any means adapted to create a continuous curtain of air between the flame and the combustion chamber. In one embodiment it consists of an annular slot disposed in a plane perpendicular to the axis which may possibly contain a grid pierced with holes or a porous material for improved air distribution.

In another embodiment it comprises a multiplicity of spouts discharging substantially parallel to the axis in the vicinity of the periphery of the combustion chamber. If the spouts are cylindrical, their number must be high (16 or more, for example) for the air curtain formed to be continuous. For the same reason the distance between the axes of two consecutive spouts must be limited, preferably to less than twice their diameter.

BRIEF DESCRIPTION OF THE DRAWING

The single figure represents by way of non-limiting example a schematic view in longitudinal cross-section of a burner in accordance with the invention.

DESCRIPTION OF THE PREFERRED EMBODIMENT

For simplicity most walls are shown by single lines, in other words their thickness is not represented. More massive parts are shown with dots or shading.

The burner is of the turbulent-flow type. It conventionally comprises a device for injecting a fluid fuel such as pulverized coal in suspension in a flow of primary air, for example, and a secondary air injector device adapted to inject secondary air along a helical trajectory around the fluid fuel.

It thus comprises a first pipe 1 for feeding the fluid fuel into an annular conduit 2 extending along an axis X—X and ending at an injection nozzle 3. This annular conduit 2 is delimited internally by a rod 2A which is generally hollow and in which there may be disposed, for example, an ignitor that is not shown (or a flame sensor, an auxiliary fuel injector conduit, etc).

The burner further comprises at least one second pipe 4 for feeding a flow of secondary air into a windbox 5, in this case disposed around the annular conduit 2. This windbox is of sufficient volume to permit proper homogenization of the secondary air fed through the pipes 4. It is axially delimited by a fixed wall 5A and a flange 5B which can slide axially along the conduit 2 by the operation of a control linkage here shown in simplified form by the line 5C. The windbox is radially delimited by a cylindrical wall 5D made up of successive sections equipped with coupling flanges and which extends axially beyond the mobile flange as far as a second fixed wall 5E which merges progressively with a tubular portion 5F surrounding the injector nozzle 3. This second fixed wall 5E carries a plurality of deflector plates or swirl vanes 6 projecting axially towards the mobile flange 5B, parallel to the axis X—X but at a specific angle to planes containing the axis X—X and intersecting these vanes. Facing these vanes are axial openings 6A in the mobile flange so as to enable the mobile flange to be moved towards the fixed wall 5E. In this way a flow of secondary air is injected around the flow of combustible fluid with a rotary movement determined by the inclination of the vanes and a flowrate regulated according to the axial position of the mobile flange.

These arrangements are conventional and are described in the aforementioned French Pat. No. 2,054,741, for example.

In an advantageous embodiment sleeves of appropriate thickness are disposed within the annular conduit 2 or within the tubular portion 5F so as to enable the velocity of the flow in these conduits to be adjusted.

In this instance the tubular portion 5F is in fact in two parts of which the first 5F' is attached to the wall 5E and the second 5F'' is attached to the first by coupling two transverse walls 5G and 10A by any known type linking means. The walls 5E and 5G are kept parallel by spacers 5H.

The tubular section 5F'' extends axially to the approximate vicinity of the end of the fluid fuel injector nozzle 3, and defines a secondary air injector nozzle 7 in the area referred to as the "burner tip".

The tubular section 5F'' is preferably joined in an area 8 called the "burner outlet" to a throat 14 which progressively widens in the direction away from the nozzles 3 and 7, being in this instance of frustoconical shape. This throat is advantageously made in a refractory material such as a refractory cement preferably resisting temperatures up to 1,400° C. In this instance the refractory material is disposed in a cylindrical bowl 14A into which it is fixed by means schematically represented at 14B. In variants on this arrangement that are not shown the bowl 14A may be frustoconical or partly cylindrical, partly frustoconical.

In accordance with the invention, a circumferentially continuous annular flow of tertiary air is injected around the combustible fluid and the secondary air, substantially along the axis X—X, in an axial ring.

The burner in accordance with the invention comprises a device for injecting a flow of tertiary air around the axis X—X, around the throat 14. This device comprises at least one tertiary air feed pipe 9 discharging into a windbox 10 delimited by the aforementioned wall 10A and section 5F'' as well as the bowl 14A accommodating said refractory material. This windbox is further delimited by a cylindrical outside wall 10B extended axially around the throat 14 by a cylindrical portion 12A which defines with the throat a substantially continuous annular tertiary air nozzle.

The portion 12A is preferably extended axially by a cylindrical confinement wall 13, here of three modular elements, delimiting a combustion chamber 11 forward of the hole. This confinement wall 13 is in practice lined with a refractory material, for example a material identical to that of the throat, preferably backed with an insulative layer 13*a*, such as an insulating mineral wool, so as to render the combustion chamber 11 substantially adiabatic.

The burner may be connected by any known means to a combustion zone wall, for example, the pipes 4 and 9 being then advantageously disposed on the same side of this wall, protected from the flame.

According to one advantageous embodiment of the invention, the velocity of the tertiary air on entering the combustion chamber is of the same order of magnitude as the average velocity of the combustion gases circulating in the same area; the tertiary air mass flowrate is preferably between 0.2 and 1.0 times the total primary and secondary air mass flowrate, which is advantageously between 0.7 and 1.2 times the mass flowrate of air neede for complete combustion of the fuel (the "stoichiometric" flowrate). This annular flow forms a thermal protection layer for the confinement wall 13 and, as it were, sheaths the mixture of gases in the combustion chamber. If the coal is relatively coarsely ground or the fuel is of low chemical reactivity (non-bituminous coal, oil coke, coal-water mixture, etc) or the environment of the flame is unfavorable to ignition, it may be advantageous to reduce the primary and secondary air mass flowrate below the stoichiometric flowrate (around 0.8 down to 0.5, for example) without compromising the final combustion of the fuel by means of additional air consisting of the tertiary air (and because there is a sufficiently long adiabatic enclosure and no recirculation of the burned gases). On the other hand, in the case of an ultra-fine ground highly reactive fuel (coal fines) or liquid fuel a primary and secondary air flowrate equal to or slightly greater than the stoichiometric flowrate may be chosen.

In the example described this annular flow is produced by a circumferentially continuous nozzle (or slot). In variants on this arrangement which are not shown, the throat 14 and the section 12A are linked by substantially radial vanes channelling the tertiary air and, where appropriate, imposing a slight rotational movement on it, or a perforated grid or a plurality of adjacent spouts, of oval or elliptical shape, for example, which (when cylindrical) are separated by a circumferential distance which is advantageously less than or equal to their diameter: thus there are generally 16 or more such spouts.

In accordance with advantageous embodiments of the invention, the diameter of the ring in which form the tertiary air is injected (in other words, in practice the diameter of the section 12A or of the confinement wall 13) is advantageously between 1.8 and 3.6 times the diameter of the burner outlet (at 8) and the tertiary air is injected downstream of the outlet at a distance preferably between 0.5 and 1.5 times the outlet diameter. The swirl number at the exit from the burner outlet is preferably between 0.3 and 2, just sufficient to create a closed internal recirculation zone favoring ignition. The combustion chamber preferably extends over a length between 0.2 and 1 times its diameter (to provide for protection of the flame). The ratio of the inlet and outlet diameters of the throat is preferably between 1.5 and 2.

Note that the length of the throat is chosen according to the time the fluid fuel is required to remain in it, which varies with the particle size of the pulverized coal, for example, whereas the ratio ot its inlet and outlet diameters is chosen according to the required aerodynamic characteristics.

The tertiary air must not be mixed with the gases leaving the throat too quickly or the stabilizing effect of the sub-stoichiometric primary and secondary air supply (where necessary) will be vitiated and the protective effect of the tertiary air with regard to the wall 13 (cooling and deposits) will be lost.

The overall air flowrate (primary plus secondary plus tertiary) is preferably between 1.2 and 1.6 times the aforementioned stoichiometric flowrate.

To give an example, if the velocity at which the fluid fuel is injected is approximately 20 m/s, the velocity of the secondary air may vary between 15 and 35 to 40 m/s and that of the tertiary air may vary between 5 and 20 to 30 m/s. The burner outlet diameter is approximately 0.20 to 0.60 m, for example.

A burner according to the invention may be fitted into a dryer drum of a roadstone drying kiln, for example.

It is obvious that the foregoing description has been given by way of non-limiting example only and that numerous variations may be put forward without departing from the scope of the invention. For example, the secondary air and the tertiary air may come from the same windbox provided with an appropriate distributor. The burner described lends itself to numerous adjustments corresponding to a wide variety of possible operating circumstances. Simplified verions of the burner with reduced adjustment capability, appropriate to specific potential application, are within the competence of those skilled in the art.

According to another variation, the combustion chamber may contain a cooling system, which may be of benefit in the case of boilers; the heat recovered by the cooling fluid is then advantageously recovered.

Another major advantage of the burner in accordance with the invention is that it may operate in any position, whereas many burners of this type may only be used in a vertical position.

There is claimed:

1. Combustion process in which a fluid fuel comprising a pulverized fuel mixed with primary air is injected along an axis, through a burner outlet extended by a frustoconical throat having an upstream end and a downstream end, said fructoconical throat extending outwardly downstream at a half angle of about 10°-35°, injecting secondary air along a helical path around said axis and through the burner outlet, and injecting unheated tertiary air in a ring from a plane defined by said downstream end of said frustoconical throat, downstream and substantially parallel to said axis around the combustible fluid and the secondary air as a substantially circumferentially continuous coaxial cylindrical air jacket laterally confined from outward expansion by a cylindrical, coaxial combustion chamber, said tertiary air being injected as a ring having a diameter between 1.8 and 3.6 times the diameter of the burner outlet, said plane from which said tertiary air is injected being downstream of the burner outlet discharging at a distance between 0.5 and 1.5 times the diameter of the burner outlet, discharging the tertiary air along and adjacent to a refractory material lined confinement wall of said cylindrical combustion chamber, said lined confinement wall extending downstream over a distance between 0.2 and 1 times the diameter of the ring.

2. Process according to claim 1, wherein the tertiary air is injected with a velocity which is of the same order of magnitude as the average velocity of the combustion gases circulating within the ring.

3. Process according to claim 1, wherein the tertiary air is injected with a mass flowrate between 0.2 and 1.5 times the total primary and secondary air mass flowrate.

4. The process of claim 1, wherein said lined confinement wall is backed by an insulating material so as to render said combustion chamber substantially adiabatic.

5. Process according to claim 3, wherein the total primary and secondary air mass flowrate is between 0.5 and 1.2 times the stoichiometric air mass flowrate.

6. Process according to claim 3, wherein the total combustion air mass flowrate is between 1.2 and 1.6 times the stoichiometric air mass flowrate.

7. Process according to claim 3, wherein the swirl number at the burner outlet is between 0.3 and 2.

8. The process of claim 7, wherein the combined primary and secondary airflow rates are about 0.5 to 0.8 of a stoichiometric flowrate.

9. The process of claim 8 wherein said lined confinement wall is backed by an insulating material so as to render said combustion chamber substantially adiabatic.

* * * * *